United States Patent [19]

Haas et al.

[11] 4,082,549

[45] Apr. 4, 1978

[54] AGGLOMERATION IMAGING PROCESS

[75] Inventors: Werner E. L. Haas, Webster; James E. Adams, Ontario; Bela Mechlowitz, Rochester, all of N.Y.

[73] Assignee: Xerox Corporation, Stamford, Conn.

[21] Appl. No.: 301,383

[22] Filed: Oct. 27, 1972

[51] Int. Cl.[2] ..... G03G 13/00

[52] U.S. Cl. ..... 96/1 R; 427/161; 250/317; 51/317; 51/319; 51/321; 96/27 R; 96/36

[58] Field of Search ..... 96/1 R, 27 R, 36; 117/1.7, 21, 93.3, 93.31, 119; 250/317, 475; 51/317, 319, 321

[56] References Cited

U.S. PATENT DOCUMENTS

| | | | |
|---|---|---|---|
| 2,798,959 | 7/1957 | Moncrieff-Yeates | 96/1 R |
| 2,872,316 | 2/1959 | Rychlewski et al. | 51/317 X |
| 2,924,519 | 2/1960 | Bertelsen | 96/1 R |
| 3,069,284 | 12/1962 | Bernot | 117/19 X |
| 3,142,579 | 7/1964 | Brooks | 117/19 X |
| 3,256,811 | 6/1966 | Bach | 250/317 X |
| 3,396,401 | 8/1968 | Nonomura | 117/21 X |
| 3,440,775 | 4/1969 | Thomas | 51/319 |
| 3,543,452 | 12/1970 | Guenther | 51/317 X |
| 3,558,881 | 1/1971 | Gold | 117/1.7 X |
| 3,653,885 | 4/1972 | Levy et al. | 96/1 PS |
| 3,671,237 | 6/1972 | Haas et al. | 96/27 R |

*Primary Examiner*—Roland E. Martin, Jr.
*Attorney, Agent, or Firm*—James J. Ralabate; John E. Beck; George J. Cannon

[57] ABSTRACT

An imaging member comprising an agglomerable layer on and not embedded in a substrate is agglomerated in image configuration to cause relative transparentizing or a color change and the formation of larger agglomerates in the agglomerated areas. This imaging process is followed by removal of the agglomerates from the agglomerated areas.

17 Claims, 3 Drawing Figures

AGGLOMERATION IMAGING PROCESS

BACKGROUND OF THE INVENTION

This invention relates in general to imaging and more specifically to a new agglomeration imaging system including a step of removing the agglomerates from the agglomerated areas.

There has recently been developed an agglomeration imaging system wherein an agglomerable layer on and not embedded in a substrate is imagewise agglomerated for example by exposure to electromagnetic radiation of sufficient energy to cause the agglomerable layer to agglomerate to cause relative transparentizing, or a color change and the formation of agglomerates in the exposed areas. Transparentizing or a color change is caused by the reduction of the effective cross-sectional area of the agglomerable layer in the imagewise exposed areas. Such an imaging system is disclosed in copending application Ser. No. 84,018, filed Oct. 26, 1970.

Other agglomeration imaging systems are disclosed in copending applications Ser. No. 755,306, filed Aug. 26, 1968, now U.S. Pat. No. 4,029,502, and Ser. No. 862,907, filed Oct. 1, 1969, now U.S. Pat. No. 3,753,706.

Another somewhat related disclosure is Haas, Adams and Mechlowitz U.S. Pat. No. 3,671,237, which while not directly related to agglomeration imaging does relate to removal of imagewise unexposed particles from a substrate.

While the above-mentioned agglomeration imaging system described in aforementioned application Ser. No. 84,018 is a most satisfactory system and while the images produced thereby are entirely suitable for many imaging applications including use as projection transparencies, the resulting image in many cases while visible, is of relatively low contrast density. For example where an amorphous selenium agglomeration layer is used the agglomeration layer is reddish black in color to start with and the image areas which are agglomerated may be changed only to a slight unaided human eye detectable change in the original reddish black color.

In other modes of the Ser. No. 84,018 system using an agglomerable layer on and not embedded in a substrate, the agglomerated image areas may be substantially completely transparentized but even though the contrast density of these images is high, when they are used as projection transparencies with relatively high magnification (for example greater than about 20*x*) and very bright projection blow back, the agglomerates in the agglomerated areas may begin to become visible and thus detract from image quality.

Thus, there is a need for providing an even higher quality agglomeration image.

Because Ser. No. 84,018 produces the images which are contrast enhanced by the process of the instant invention the disclosure of Ser. No. 84,018 is hereby expressly incorporated herein by reference.

SUMMARY OF THE INVENTION

It is, therefore, an object of this invention to provide a method of agglomeration imaging which overcomes the above-noted deficiencies and satisfies the above-noted needs.

It is another object of this invention to provide a method of removing unwanted agglomerates from an agglomeration image comprising an agglomerable layer in image configuration and a complementary image configuration comprising larger agglomerates of said agglomerable layer both contacting and on but not embedded in a substrate.

It is a further object of this invention to provide a method of converting low contrast density agglomeration images to high contrast density images.

It is a further object of this invention to provide a method of converting, often dramatically, low contrast density agglomeration images to high contrast density images by completely removing agglomeration material from the agglomerated areas of the imaged member to leave the member in those areas the density of the substrate.

It is a further object of this invention to provide a method of producing agglomeration images of high contrast density with substantially complete transparentization in the agglomerated areas, from agglomerable layers and material that may be incapable of being substantially transparentized by the agglomeration effect alone.

It is a further object of this invention to provide a method of producing agglomeration images of high contrast density where the image agglomeration step is capable of higher sensitivities because the image agglomeration step alone need not provide high contrast density images.

The foregoing objects and others are accomplished in accordance with this invention by applying an agglomerate removing force, usually uniformly to the entire imaged surface of an agglomeration imaged member, said force being sufficient to remove the larger agglomerates but, surprisingly, insufficient to remove the unagglomerated portions of the agglomerable layer or at least insufficient to remove enough unagglomerated portions to be detectable by the unaided human eye. The agglomeration imaged member comprises an agglomerable layer contacting and on but not embedded in a substrate; the agglomerable layer having been imagewise agglomerated to form agglomerates, which also contact and are on but not embedded in the substrate, said agglomerates larger than the individual bits of the agglomerable layer used to form each agglomerate.

BRIEF DESCRIPTION OF THE DRAWINGS

For a better understanding of the invention as well as other objects and further features thereof, reference is made to the following detailed disclosure of this invention taken in conjunction with accompanying drawings wherein.

DESCRIPTION OF THE PREFERRED EMBODIMENTS

Figure 1:
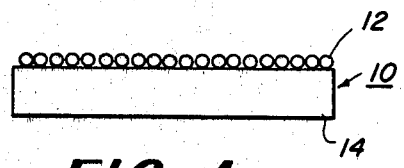
FIG. 1 is a partially schematic, cross-sectional view of an imaging member suitable for use in the present invention.

Referring now to FIG. 1 there is seen imaging member 10 comprising an agglomerable layer 12 on and not embedded in a substrate 14. Any substrate which is capable of holding agglomerable layer 12 on and not embedded in it and which has sufficient mechanical strength to so carry layer 12 in the imagewise agglomeration process used to form the imaged member described in FIG. 2 and in the agglomerate removal step of this invention may be used.

Typically substrate 14 may be a metal layer, or paper or a plastic such as Mylar, a polyethylene terephthalate resin film available from duPont. Any suitable form, such as sheet, web, moebius strip may be used.

Agglomerable layer 12 may comprise any suitable agglomerable material including electrical insulators, electrical conductors, photoconductive materials and non-photoconductive materials.

Agglomerate, agglomerable and the several variant forms thereof used herein defines the effect or capability of massing or fusing together of the imagewise agglomerated portions of layer 12 to reduce the cross-sectional area of the agglomerable layer in these portions to transparentize or at least effect a human eye detectable color change of layer 12 in said portions, the color change apparently associated with the light scattering caused, for example, by the particles in the imaged areas of a particle layer 12 (see copending application Ser. No. 837,780, filed June 30, 1969, now U.S. Pat. No. 3,975,195); specifically including the massing together of closely packed particles into a smaller number of larger spheres of less cross-sectional area.

In fact, greater sensitivities may be obtained for color changes as opposed to a change to near complete transparency, even though lower contrast density images are usually produced. The instant invention provides a means to convert these lower contrast density images to high contrast density images.

Preferred agglomerable materials for use herein, because of the excellent quality of the resultant images and because of the sensitivity of the system include: amorphous selenium, amorphous selenium alloyed with arsenic, tellurium, antimony, bismuth, etc.; amorphous selenium or its alloys doped with halogens; tellurium, mixtures of amorphous selenium and one or more crystalline forms of selenium including the monoclinic and hexagonal forms, arsenic and zinc.

An optimum agglomerable material comprises predominantly, i.e., greater than 50% by weight, amorphous selenium.

It is found that especially suitable materials for layer 12 especially where the agglomeration image is formed by the preferred radiation exposure mode, generally have a low glass transition temperature (where the materials have a glass transition temperature at all) i.e., generally below about 50° or 60° C. and a high absorption coefficient for the radiation used, such as selenium.

Any suitable agglomerable material may be used in layer 12. Typical additional agglomerable materials include sulfur, dyed polyvinyl carbazole, gallium, cobalt tricarbonyl; thermoplastics or dyed thermoplastics such as polyoctylacrylate, polylaurylmethacrylate; dyed waxes, dyed paraffins, and others. Such materials may be dyed with any suitable material, such as phthalocyanine dyes, fluorescein dyes, or any other dye colorant; a host of materials suitable for use as such dyes is set forth in U.S. Pat. No. 3,384,488. In addition, the agglomerable material may comprise particulate material comprising an agglomerable matrix which contains smaller pigment particles. For example, the thermoplastic materials listed above are particularly suitable for such large particle matrices, while any suitable pigment such as zinc oxide, titanium dioxide, lead oxide, phthalocyanine pigments, or other suitable marking pigment may be used as pigment particles in the agglomerable matrix.

Agglomerable layer 12 is shown to be a microscopically discontinuous layer of closely packed particles. It is preferred for images of highest resolution, density and utility and to provide for the most sensitive system that layer 12 be a microscopically discontinuous layer and optimally that the layer 12 be particulate in order to best promote the agglomerating effect.

For best results layer 12 is preferably from about 0.01 to about 2 microns thick comprising particles of the same average size although about 0.05 to about 5 micron, or even thicker layers may give agglomeration images.

Even better layers in this regard are thin i.e., below about 1 micron and, optimally between about 0.1 and about 0.5 micron thick microscopically discontinuous particle layers of average particle size between about 0.1 and about 0.5 microns, comprising predominantly amorphous selenium, for example, vacuum evaporated by techniques as disclosed in Goffe et al U.S. Pat. No. 3,598,644. Microscopically discontinuous layer 12 may also be formed by other methods such as cascading, dusting, etc., as shown in Goffe U.S. Pat. No. 3,520,681 or by stripping and other methods as described in copending application Ser. No. 685,536, filed Nov. 24, 1967, now abandoned, or any other suitable method.

Especially suitable selenium films when viewed under a microscope at least show either a network of cracks or apertures or else a network of dark lines indicating a microscopically discontinuous layer. Electron micrographs show that optimum predominantly amorphous selenium films are actually composed of discrete spherical amorphous particles of an average particle size optimally between about 0.1 and about 0.5 microns.

It is preferred that particles of this optimum particle size have center to center, particle spacings of not greater than about ½ micron, although in some embodiments, larger particle-to-particle spacings are suitable. Closely packed particle agglomeration layers facilitate agglomeration.

Figure 2:
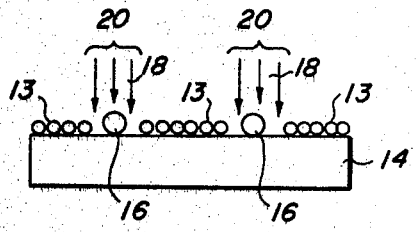
FIG. 2 is a partially schematic, cross-sectional view of the imaging member of FIG. 1 being imaged, showing the resultant image of agglomerate areas 20 and unagglomerated areas 13.

Referring now to FIG. 2 there is shown the imaging member of FIG. 1 being imagewise exposed to radiation 18 which causes the agglomerable layer 12 in imagewise exposed areas to agglomerate to form agglomerates 16. Further particulars on this agglomeration imaging system may be found in aforementioned copending application Ser. No. 84,018.

Imagewise exposure typically comprises exposing the aforementioned imaging members with a short duration exposure of electromagnetic radiation of high intensity. Radiation of high intensity is intended to mean radiation with radiant energies in the range between about 0.001 and about 0.3 joules/cm$^2$ in exposures of duration in the range between about one and about $10^4$ microseconds, although in various embodiments, somewhat shorter or longer exposure durations may be suitable for the production of satisfactory images. This radiation also typically is of wavelengths in the range between about 2,000 A and about 26,000 A. The radiation sources useful in the present invention, such as Xenon flash lamps and lasers, typically emit radiant energy which comprises at least heat and light, as indicated by the wavelength and energy ranges above.

The short duration, high intensity, flash imaging technique is particularly advantageous because the energy imparted to the imaging member is not continuously applied and therefore has little time in which to be conducted away to other portions of the imaging member. The energy is so quickly applied to such localized areas of the imaging member, that the local effects occur before the energy has time to be conducted away from the imaged areas. These facts contribute to the high resolutions which are a characteristic result of the present imaging system.

It is seen that agglomeration causes reduction of the cross-sectional area of layer 12 by the formation of larger spheres 16 of the same mass as the total mass of the smaller particles of layer 12 which were agglomerated together to form the sphere 16, but taking up a smaller surface area on substrate 14 than the total of the surface areas of the smaller particles of layer 12 which were agglomerated together to form each agglomerate.

The agglomeration of the individual particles of the agglomeration layer selectively reduces the density in image areas of the imaged member. In some modes the agglomerated areas are reduced to about zero agglomerable layer density, i.e. the resulting agglomerates are not visible to the naked eye and the only density left is that of the substrate. The reduction in optical density is due to the substantial reduction in the cross-sectional area of the agglomeration material on the substrate. The agglomerates of agglomerable layer material in the complete agglomeration mode are typically 5 to 10 times larger in diameter than the original agglomerable layer particles.

Figure 3:
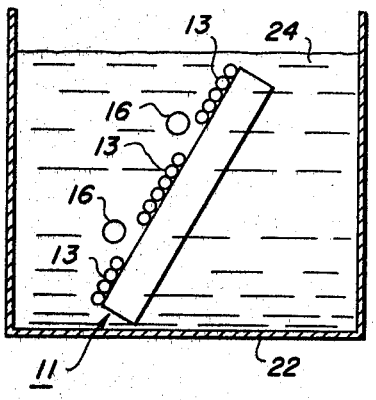
FIG. 3 shows one mode of removing agglomerates by contacting the imaged member 11 with a liquid.

Referring now to FIG. 3 there is shown one mode of removing the agglomerates 16 by dunking the imaged member 11 in a beaker 22 of liquid 24. This provides one convenient method for providing an agglomerate removal force across the imaged member of a force sufficient to remove the larger agglomerates 16 but insufficient to remove the other non-agglomerated portions 13 of the agglomerable layer which as disclosed herein above in the preferred embodiment is comprised of small particles.

It is clear that any suitable method of providing an agglomerate removing force across the imaged member may be used, which is sufficient to remove the larger agglomerates but insufficient to remove the unagglomerated portions of the agglomerable layer, including rubbing cotton under hand-type pressures or causing other solid abrasive material to pass in contact across the imaged member or by applying a high pressure jet of gas such as air across the imaged member or a jet of liquid or by abrasion in a liquid bath with or without abrasive particles. Another mode would be to cause relative movement between the imaged member and abrasive particles which could be contained in a high pressure jet of gas or liquid. Vibration including ultrasonic vibration of the imaged member relative to a liquid or abrasive particles may be used.

The following examples further specifically define the present invention of removing agglomerates from imaged members comprising an agglomerable layer in image configuration and a complementary image configuration comprising larger agglomerates of said agglomerable layer both contacting and on but not embedded in a substrate. The parts and percentages are by weight unless otherwise indicated. The examples below are intended to illustrate various preferred embodiments of the agglomerate removal process of this invention.

EXAMPLE I

An imaging member like that illustrated in FIG. 1 is prepared by vacuum evaporating a microscopically discontinuous layer of amorphous selenium, approximately 0.2 microns in thickness, on a Mylar substrate. The vacuum evaporation process is carried out by the process disclosed in Goffe et al U.S. Pat. No. 3,598,644, with the process carried out on the Mylar substrate of this Example, as opposed to the softened substrates of U.S. Pat. No. 3,598,644, to form a layer of amorphous selenium particles residing on the surface of the Mylar.

This imaging member is then exposed to an optical image by providing over the surface of the imaging member an optical mask, here in the form of a resolution target, and the imaging member is exposed at a distance of about 3 inches, by radiant energy in the illuminated areas of about 0.2 joules/cm$^2$. by flashing a Novatron Xenon flash lamp available from the Xenon Corporation, for a time duration of about 50 microseconds. The xenon lamp has an emission spectrum in the range between about 2,000 and 25,000 A.

This method provides a faithful image replica on the imaging member of the optical image mask. The low contrast, unaided human eye detectable image comprises less dense i.e. lighter colored areas of selenium in the exposed areas where the microscopically discontinuous selenium layer has agglomerated and fused into particles of lesser total cross-sectional area, with the background portions of the imaging member comprising the original density of the microscopically discontinuous selenium layer. Using collimated monochromatic projection input light at 5,000 angstroms from a Bausch and Lomb monochromator and a photodiode on the other side of the imaged member, transmissiveness of the imaged member in agglomerated areas is measured to be about 20% of the input radiation.

The imaged member is then dunked in $CHCl_3$ (chloroform) and removed. The agglomerated areas show the striking effect of having all the selenium removed to leave a bare Mylar substrate. A high contrast image results. Transmissiveness of the agglomerated areas is then measured by the same technique as described in the previous paragraph and is shown to have been dramatically increased to near 100% with no unaided human eye noticeable change in density of the unagglomerated areas.

EXAMPLE II

Example I is followed except that instead of removing the agglomerates by dunking in chloroform a swab of cotton is lightly hand wiped once over the imaged member to remove the agglomerates in the exposed areas.

Given these surprising results i.e., that the agglomerates can be removed without materially disturbing the unagglomerated areas of the agglomeration layer, it may be postulated as the reason for this result that the larger agglomerated particles are less affected by Van der Waal's forces and thus are more readily removable from the substrate i.e., the adhesion of the agglomerated imaging layer in the imagewise exposed areas is apparently selectively reduced as a result of the exposure step. The differential in adhesion between the agglomerated and the unagglomerated areas is sufficient so that the agglomerated portions can be removed without removing the unagglomerated areas of the agglomerable layer.

Although specific components and processes have been stated in the above description of preferred embodiments of the agglomerate removal system of this invention, other suitable materials and processes as listed herein, may be used with similar results and various degrees of quality.

In addition, other materials and methods which exist presently or may be discovered may be used to synergize and enhance or otherwise modify the invention.

For example, the initial image agglomeration may take place by techniques other than flash exposure to electromagnetic radiation. Imagewise heating the agglomerable layer by contact or convection or imagewise softening the agglomerable layer by softening vapors may be used. Also another agglomerate removing force may be provided by cascading abrasive particles such as alumina across an agglomeration imaged member.

It will be understood that various other changes in the details, materials, steps and arrangements of parts which have been herein described and illustrated in order to explain the nature of the invention, will occur to and may be made by those skilled in the art upon a reading of this disclosure and such changes are intended to be included within the principle and scope of this invention.

What is claimed is:

1. An imaging method comprising:

(a) providing on a substrate an about 0.05 to about 5 micron thick microscopically discontinuous layer of particles having an average diameter of about 0.5 to about 5 microns and center to center particle spacings of up to about 5 microns; said particles comprising material selected from the group consisting of amorphous selenium, amorphous selenium alloys, tellurium, mixtures of amorphous selenium and crystalline selenium, arsenic, zinc, sulfur, dyed polyvinyl carbazole, gallium, cobalt tricarbonyl, thermoplastics, dyed thermoplastics, dyed waxes and dyed paraffins;

(b) imagewise exposing said discontinuous layer to radiation of about 2,000 to about 26,000 A in wavelength and at an energy of about 0.001 to about 0.3 joules/cm$^2$ for about 1 to about $10^4$ microseconds wherein the total cross-sectional area of particles in imagewise exposed areas is decreased; and (c) removing particles from said substrate in imagewise exposed areas.

2. The imaging method of claim 1 wherein the particles in the imagewise exposed areas are removed by applying a removing force to an entire surface of the layer of particles, the force being sufficient to remove the particles in exposed areas and insufficient to remove particles in non-imagewise exposed areas, wherein an imaged member of higher contrast density is produced.

3. The imaging method of claim 2 wherein said removing force is applied by steps comprising causing relative movement between the layer of particles and a fluid.

4. The imaging method of claim 1 wherein said layer comprises particles having average particle size not greater than about 1 micron.

5. The imaging method of claim 1 wherein said layer particles comprise selenium.

6. The imaging method of claim 5 wherein said layer particles comprise predominantly amorphous selenium.

7. The imaging method of claim 3 wherein said fluid is a liquid.

8. The imaging method of claim 4 wherein said layer comprises particles having average particle size not greater than about 0.5 microns.

9. The imaging method of claim 8 wherein said particles have center to center particle spacings not greater than about ½ micron.

10. The imaging method of claim 1 wherein the source of said radiation is a Xenon gas discharge lamp.

11. The imaging method of claim 1 wherein the source of said radiation is a laser.

12. An imaging method comprising:

(a) providing on a substrate, an agglomerable layer;

(b) imagewise exposing said agglomerable layer to radiation at an energy level and for a period of time effective to decrease the total cross-sectional area of agglomerable material in said agglomerable layer in imagewise exposed areas; and (c) removing imagewise exposed agglomerable material from said substrate.

13. The imaging method of claim 12 wherein the imagewise exposed agglomerable material is removed by applying a removing force to an entire surface of the agglomerable layer, the force being sufficient to remove agglomerable material in exposed areas and insufficient to remove agglomerable material in non-imagewise exposed areas, wherein an imaged member of higher contrast density is produced.

14. The imaging method of claim 13 wherein said removing force is applied by steps comprising causing relative movement between the agglomerable layer and a fluid.

15. The imaging method of claim 12 wherein said agglomerable layer comprises particles of agglomerable material having an average particle size not greater than about 1 micron.

16. The imaging method of claim 15 wherein said agglomerable material particles comprise selenium.

17. The imaging method of claim 16 wherein said agglomerable material particles comprise predominantly amorphous selenium.

* * * * *